US008802344B2

(12) United States Patent
Lai et al.

(10) Patent No.: US 8,802,344 B2
(45) Date of Patent: Aug. 12, 2014

(54) TONER PROCESSES UTILIZING WASHING AID

(75) Inventors: Zhen Lai, Webster, NY (US); Chieh-Min Cheng, Rochester, NY (US); Zhaoyang Ou, Webster, NY (US); Christopher D. Blair, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 253 days.

(21) Appl. No.: 12/966,183

(22) Filed: Dec. 13, 2010

(65) Prior Publication Data

US 2012/0148950 A1 Jun. 14, 2012

(51) Int. Cl.
*G03G 9/08* (2006.01)
*G03G 9/087* (2006.01)

(52) U.S. Cl.
CPC ..... *G03G 9/0804* (2013.01); *G03G 9/08797* (2013.01); *G03G 9/0823* (2013.01)
USPC ..... 430/137.14; 430/137.1; 430/137.22; 430/110.1

(58) Field of Classification Search
USPC ..... 430/137.1–137.22, 110.1–110.4
See application file for complete search history.

(56) References Cited

U.S. PATENT DOCUMENTS

| | | | | |
|---|---|---|---|---|
| 3,590,000 | A | 6/1971 | Palermiti et al. | |
| 4,298,672 | A | 11/1981 | Lu | |
| 4,338,390 | A | 7/1982 | Lu | |
| 5,290,654 | A | 3/1994 | Sacripante et al. | |
| 5,302,486 | A | 4/1994 | Patel et al. | |
| 5,639,584 | A * | 6/1997 | Anno et al. | 430/137.18 |
| 5,853,943 | A | 12/1998 | Cheng et al. | |
| 5,902,710 | A | 5/1999 | Ong et al. | |
| 5,910,387 | A | 6/1999 | Mychajlowskij et al. | |
| 5,916,725 | A | 6/1999 | Patel et al. | |
| 5,919,595 | A | 7/1999 | Mychajlowskij et al. | |
| 5,925,488 | A | 7/1999 | Patel et al. | |
| 5,977,210 | A | 11/1999 | Patel et al. | |
| 5,994,020 | A | 11/1999 | Patel et al. | |
| 6,214,507 | B1 | 4/2001 | Sokol et al. | |
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 7,329,476 | B2 | 2/2008 | Sacripante et al. | |
| 7,452,646 | B2 | 11/2008 | Hu et al. | |
| 2006/0029878 | A1 * | 2/2006 | Yoshizawa et al. | 430/124 |
| 2006/0216626 | A1 | 9/2006 | Sacripante et al. | |
| 2007/0088117 | A1 | 4/2007 | Zhou et al. | |
| 2007/0281237 | A1 * | 12/2007 | Iwamoto et al. | 430/123.5 |
| 2008/0107989 | A1 | 5/2008 | Sacripante et al. | |
| 2008/0107990 | A1 | 5/2008 | Field et al. | |
| 2008/0153025 | A1 * | 6/2008 | Lai et al. | 430/109.3 |
| 2008/0236446 | A1 | 10/2008 | Zhou et al. | |
| 2008/0261144 | A1 * | 10/2008 | Ikuta et al. | 430/137.14 |
| 2009/0047593 | A1 * | 2/2009 | Vanbesien et al. | 430/110.2 |
| 2009/0233203 | A1 * | 9/2009 | Yuasa et al. | 430/108.4 |

* cited by examiner

*Primary Examiner* — Mark F Huff
*Assistant Examiner* — Rashid Alam
(74) *Attorney, Agent, or Firm* — MDIP LLC

(57) ABSTRACT

A process for making toner particles is provided. In embodiments, a suitable process includes adding a washing aid agent to toner particles at the time of washing the toner particles prior to their drying and recover. The washing aid agent assist in the removal of ionic species, including surfactants and ions that are part of the emulsion aggregation process, from the resulting toner particles. Utilization of the washing aid agent produces toner particles having improved charging characteristics.

14 Claims, No Drawings

TONER PROCESSES UTILIZING WASHING AID

TECHNICAL FIELD

The present disclosure relates to processes for producing toners suitable for electrophotographic apparatuses. More specifically, the present disclosure relates to processes and toners utilizing a washing aid in forming the toner particles.

BACKGROUND

Numerous processes are within the purview of those skilled in the art for the preparation of toners. Emulsion aggregation (EA) is one such method. EA toners may be used in forming print and/or electrophotographic images. EA techniques may involve the formation of an emulsion latex of the resin particles by heating the resin using a batch or semi-continuous emulsion polymerization, as disclosed in, for example, U.S. Pat. No. 5,853,943, the disclosure of which is hereby incorporated by reference in its entirety. Other examples of emulsion/aggregation/coalescing processes for the preparation of toners are illustrated in U.S. Pat. Nos. 5,902,710; 5,910,387; 5,916,725; 5,919,595; 5,925,488, 5,977,210, 5,994,020, and U.S. Patent Application Publication No. 2008/0107989, the disclosures of each of which are hereby incorporated by reference in their entirety.

Combinations of amorphous and crystalline polyesters may be used to form toners having relatively low-melting point characteristics (sometimes referred to as low-melt, ultra low melt, or ULM), which allows for more energy-efficient and faster printing.

EA toner processes include coagulating a combination of emulsions, i.e., emulsions including a latex, wax, pigment, and the like, with a flocculent such as polyaluminum chloride and/or aluminum sulfate, to generate a slurry of primary aggregates which then undergo a controlled aggregation process. A stable triboelectric charge is very important for toner performance. Residual surfactants and/or ions on the toner surface play very important roles in toner charging, charging maintenance, and relative humidity (RH) sensitivity. Currently, a washing process using water is used to remove surfactants/ions on the particle surface. However, this washing process is not very effective, as it requires a large amount of washing water, multiple washing steps and a long cycle time. Additionally, this conventional washing process can only wash off surfactants/ions from the particle surface, but cannot wash out surfactants/ions just beneath the outer particle surface, which may also be critical to triboelectric performance of the toner particles.

Improved methods for producing toners having stable charging characteristics remain desirable.

SUMMARY

The present disclosure provides methods for producing toners and toners produced thereby. In embodiments, a method of the present disclosure includes contacting at least one resin with at least one surfactant, an optional wax, and an optional colorant to form a primary slurry; aggregating the at least one resin with an aggregating agent to form aggregated particles; coalescing the aggregated particles to form toner particles; contacting the toner particles with at least one washing aid agent including from about 1 hydroxyl groups to about 4 hydroxyl groups; washing the toner particles; and recovering the toner particles.

In other embodiments, a method of the present disclosure includes contacting at least one amorphous polyester resin with at least one crystalline polyester resin, at least one surfactant, an optional wax, and an optional colorant to form a primary slurry; aggregating the at least one amorphous polyester resin in combination with at least one crystalline polyester resin with an aggregating agent to form aggregated particles; coalescing the aggregated particles to form toner particles; contacting the toner particles with at least one washing aid agent including from about 1 hydroxyl groups to about 4 hydroxyl groups; washing the toner particles; and recovering the toner particles.

In yet other embodiments, a method of the present disclosure includes contacting at least one amorphous polyester resin with at least one crystalline polyester resin, at least one surfactant, an optional wax, and an optional colorant to form a primary slurry; aggregating the at least one amorphous polyester resin in combination with at least one crystalline polyester resin with an aggregating agent to form aggregated particles; coalescing the aggregated particles to form toner particles; contacting the toner particles with at least one washing aid agent such as 2-phenoxy ethanol, propylene glycol, 1-(2-butoxyethoxy)-ethanol, diethylene glycol monobutyl ether, ethylene glycol monopropyl ether, ethylene glycol monohexyl ether, diethylene glycol monomethyl ether, diethylene glycol monoethyl ether, diethylene glycol monohexyl ether, triethylene glycol monomethyl ether, triethylene glycol monoethyl ether, triethylene glycol monobutyl ether, and combinations thereof, in an amount of from about 0.001% to about 10% by weight of the toner particles; washing the toner particles; and recovering the toner particles.

DETAILED DESCRIPTION

The present disclosure provides processes for producing toner particles. In embodiments, a process of the present disclosure includes a highly efficient washing process for ULM EA toners by introducing a washing aid agent. The washing aid agent acts as a resin dissolver, which helps to swell the toner particle surface, so that surfactants absorbed to the surface of the toner particle, as well as surfactants/ions inside the toner particle, but near to the particle surface, can be easily washed off. This can ensure robust EA toners with good charging, charge maintenance, and temperature and RH sensitivities.

Resins

Toners of the present disclosure may include any latex resin suitable for use in forming a toner. Such resins, in turn, may be made of any suitable monomer.

The resins may be made by any suitable polymerization method. In embodiments, the resin may be prepared by emulsion polymerization. In other embodiments, the resin may be prepared by condensation polymerization.

In embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, a resin utilized in forming a toner may include an amorphous polyester resin. In embodiments, the resin may be a polyester resin formed by reacting a dial with a diacid or diester in the presence of an optional catalyst.

Examples of organic diols selected for the preparation of amorphous resins include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of diacid or diesters selected for the preparation of the amorphous polyester include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, dodecenylsuccinic acid, dodecenylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, dimethyl dodecenylsuccinate, and mixtures thereof. The organic diacid or diester is selected, for example, from about 45 to about 52 mole percent of the resin.

Examples of suitable polycondensation catalyst for either the amorphous polyester resin include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

Exemplary amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly(propoxylated bisphenol A co-terephthalate), a terpoly(propoxylated bisphenol A co-fumarate)-terpoly(propoxylated bisphenol A co-terephthalate)-terpoly-(propoxylated bisphenol A co-dodecylsuccinate), and combinations thereof. In embodiments, the amorphous resin utilized in the core may be linear.

In embodiments, a suitable amorphous resin may include alkoxylated bisphenol A fumarate/terephthalate based polyester and copolyester resins. In embodiments, a suitable amorphous polyester resin may be a copoly(propoxylated bisphenol A co-fumarate)-copoly(propoxylated bisphenol A co-terephthalate) resin having the following formula (I):

(I)

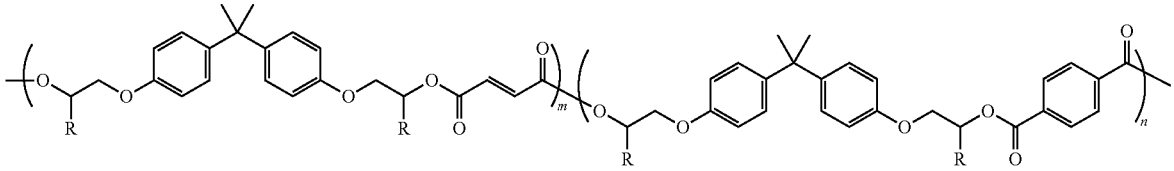

wherein R may be hydrogen or a methyl group, and m and n represent random units of the copolymer and m may be from about 2 to 10, and n may be from about 2 to 10.

An example of a linear copoly(propoxylated bisphenol A co-fumarate)-copoly(propoxylated bisphenol A co-terephthalate) which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

In embodiments, the amorphous polyester resin may be a saturated or unsaturated amorphous polyester resin. Illustrative examples of saturated and unsaturated amorphous polyester resins selected for the process and particles of the present disclosure include any of the various amorphous polyesters, such as polyethylene-terephthalate, polypropylene-terephthalate, polybutylene-terephthalate, polypentylene-terephthalate, polyhexylene-terephthalate, polyheptadene-terephthalate, polyoctalene-terephthalate, polyethylene-isophthalate, polypropylene-isophthalate, polybutylene-isophthalate, polypentylene-isophthalate, polyhexylene-isophthalate, polyheptadene-isophthalate, polyoctalene-isophthalate, polyethylene-sebacate, polypropylene sebacate, polybutylene-sebacate, polyethylene-adipate, polypropylene-adipate, polybutylene-adipate, polypentylene-adipate, polyhexylene-adipate, polyheptadene-adipate, polyoctalene-adipate, polyethylene-glutarate, polypropylene-glutarate, polybutylene-glutarate, polypentylene-glutarate, polyhexylene-glutarate, polyheptadene-glutarate, polyoctalene-glutarate polyethylene-pimelate, polypropylene-pimelate, polybutylene-pimelate, polypentylene-pimelate, polyhexylene-pimelate, polyheptadene-pimelate, poly(ethoxylated bisphenol A-fumarate), poly(ethoxylated bisphenol A-succinate), poly(ethoxylated bisphenol A-adipate), poly(ethoxylated bisphenol A-glutarate), poly(ethoxylated bisphenol A-terephthalate), poly(ethoxylated bisphenol A-isophthalate), poly(ethoxylated bisphenol A-dodecenylsuccinate), poly(propoxylated bisphenol A-fumarate), poly(propoxylated bisphenol A-succinate), poly (propoxylated bisphenol A-adipate), poly(propoxylated bisphenol A-glutarate), poly(propoxylated bisphenol A-terephthalate), poly(propoxylated bisphenol A-isophthalate), poly(propoxylated bisphenol A-dodecenylsuccinate), SPAR (Dixie Chemicals), BECKOSOL (Reichhold Inc), ARAKOTE (Ciba-Geigy Corporation), HETRON (Ashland Chemical), PARAPLEX (Rohm & Haas), POLYLITE (Reichhold Inc), PLASTHALL (Rohm & Haas), CYGAL (American Cyanamide), ARMCO (Armco Composites), ARPOL (Ashland Chemical), CELANEX (Celanese Eng), RYNITE (DuPont), STYPOL (Freeman Chemical Corporation) and combinations thereof. The resins can also be functionalized, such as carboxylated, sulfonated, or the like, and particularly such as sodio sulfonated, if desired.

The amorphous polyester resin may be a branched resin. As used herein, the terms "branched" or "branching" includes branched resin and/or cross-linked resins. Branching agents for use in forming these branched resins include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Linear or branched unsaturated polyesters selected for reactions include both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups such as carboxyl, hydroxy, and the like groups amenable to acid-base reactions. Typical unsaturated polyester resins may be prepared by melt polycondensation or other polymerization processes using diacids and/or anhydrides and dials.

In embodiments, a suitable amorphous resin utilized in a toner of the present disclosure may be a low molecular weight amorphous resin, sometimes referred to, in embodiments, as an oligomer, having a weight average molecular weight (Mw) of from about 500 daltons to about 10,000 daltons, in embodiments from about 1000 daltons to about 5000 daltons, in other embodiments from about 1500 daltons to about 4000 daltons.

The low molecular weight amorphous resin may possess a glass transition temperature (Tg) of from about 45° C. to about 70° C., in embodiments from about 50° C. to about 64° C. These low molecular weight amorphous resins may be referred to, in embodiments, as a high Tg amorphous resin.

The low molecular weight amorphous resin may possess a softening point of from about 105° C. to about 118° C., in embodiments from about 107° C. to about 109° C.

The low molecular weight amorphous polyester resins may have an acid value of from about 8 to about 20 mg KOH/g, in embodiments from about 9 to about 16 mg KOH/g, and in embodiments from about 11 to about 15 mg KOH/g.

In other embodiments, an amorphous resin utilized in forming a toner of the present disclosure may be a high molecular weight amorphous resin. As used herein, the high molecular weight amorphous polyester resin may have, for example, a number average molecular weight ($M_n$), as measured by gel permeation chromatography (GPC) of, for example, from about 1,000 Daltons to about 10,000 Daltons, in embodiments from about 2,000 Daltons to about 9,000 Daltons, in embodiments from about 3,000 Daltons to about 8,000 Daltons, and in embodiments from about 6,000 Daltons to about 7,000 Daltons. The weight average molecular weight ($M_w$) of the resin is greater than 45,000 Daltons, for example, from about 45,000 Daltons to about 150,000 Daltons, in embodiments from about 50,000 Daltons to about 100,000 Daltons, in embodiments from about 63,000 Daltons to about 94,000 Daltons, and in embodiments from about 68,000 Daltons to about 85,000 Daltons, as determined by GPC using polystyrene standard. The polydispersity index (PD) is above about 4, such as, for example, greater than about 4, in embodiments from about 4 to about 20, in embodiments from about 5 to about 10, and in embodiments from about 6 to about 8, as measured by GPC versus standard polystyrene reference resins. The PD index is the ratio of the weight-average molecular weight ($M_w$) and the number-average molecular weight ($M_n$).

The high molecular weight amorphous polyester resins, which are available from a number of sources, can possess various melting points of, for example, from about 30° C. to about 140° C., in embodiments from about 75° C. to about 130° C., in embodiments from about 100° C. to about 125° C., and in embodiments from about 115° C. to about 124° C.

High molecular weight amorphous resins may possess a glass transition temperature of from about 45° C. to about 70° C., in embodiments from about 50° C. to about 60° C. These high molecular weight amorphous resins may be referred to, in embodiments, as a low Tg amorphous resin, which have a Tg lower than the high Tg amorphous resins noted above.

In embodiments, a combination of low Tg and high Tg amorphous resins may be used to form a toner of the present disclosure. The ratio of low Tg amorphous resin to high Tg amorphous resin may be from about 0:100 to about 100:0, in embodiments from about 30:70 to about 70:30. In embodiments, the combined amorphous resins may have a melt viscosity of from about 10 to about 1,000,000 Pa*S at about 130° C., in embodiments from about 50 to about 100,000 Pa*S.

The amorphous resin is generally present in the toner composition in various suitable amounts, such as from about 60 to about 90 weight percent, in embodiments from about 50 to about 65 weight percent, of the toner or of the solids.

In embodiments, the toner composition may include at least one crystalline resin. As used herein, "crystalline" refers to a polyester with a three dimensional order. "Semicrystalline resins" as used herein refers to resins with a crystalline percentage of, for example, from about 10 to about 90%, in embodiments from about 12 to about 70%. Further, as used herein, "crystalline polyester resins" and "crystalline resins" encompass both crystalline resins and semicrystalline resins, unless otherwise specified.

In embodiments, the crystalline polyester resin is a saturated crystalline polyester resin or an unsaturated crystalline polyester resin.

For forming a crystalline polyester, suitable organic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), polypropylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof. The crystalline resin may be present, for example, in an amount of from about 5 to about 50 percent by weight of the toner components, in embodiments from about 10 to about 35 percent by weight of the toner components.

The crystalline polyester resins, which are available from a number of sources, may possess various melting points of, for example, from about 30° C. to about 120° C., in embodiments from about 50° C. to about 90° C. The crystalline resins may have, for example, a number average molecular weight ($M_n$), as measured by gel permeation chromatography (GPC) of, for example, from about 1,000 Daltons to about 50,000 Daltons, in embodiments from about 2,000 Daltons to about 25,000 Daltons, in embodiments from about 3,000 Daltons to about 15,000 Daltons, and in embodiments from about 6,000 Daltons to about 12,000 Daltons. The weight average molecular weight ($M_w$) of the resin is 50,000 or less, for example, from about 2,000 Daltons to about 50,000 Daltons, in embodiments from about 3,000 Daltons to about 40,000 Daltons, in embodiments from about 10,000 Daltons to about 30,000 Daltons and in embodiments from about 21,000 Daltons to about 24,000 Daltons, as determined by GPC using polystyrene standards. The molecular weight distribution ($M_w/M_n$) of the crystalline resin is, for example, from about 2 to about 6, in embodiments from about 3 to about 4. The crystalline polyester resins may have an acid value of about 2 to about 20 mg KOH/g, in embodiments from about 5 to about 15 mg KOH/g, and in embodiments from about 8 to about 13 mg KOH/g. The acid value (or neutralization number) is the mass of potassium hydroxide (KOH) in milligrams that is required to neutralize one gram of the crystalline polyester resin.

Suitable crystalline polyester resins include those disclosed in U.S. Pat. No. 7,329,476 and U.S. Patent Application Publication Nos. 2006/0216626, 2008/0107990, 2008/0236446 and 2009/0047593, each of which is hereby incorporated by reference in their entirety. In embodiments, a suitable crystalline resin may include a resin composed of ethylene glycol or nonanediol and a mixture of dodecanedioic acid and fumaric acid co-monomers with the following formula (II):

(II)

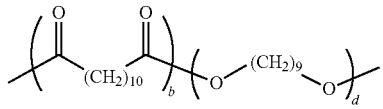

wherein b is from about 5 to about 2000 and d is from about 5 to about 2000.

If semicrystalline polyester resins are employed herein, the semicrystalline resin may include poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly(decamethylene adipate), poly(decamethylene azelaate), poly(hexamethylene oxalate), poly(decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly(tetramethylene trithiodicarboxylate), poly(trimethylene dodecane dioate), poly(m-xylene), poly(p-xylylene pimelamide), and combinations thereof.

A crystalline polyester resin in a toner particle of the present disclosure may be present in an amount of from about 1 to about 15 percent by weight, in embodiments from about 5 to about 10 percent by weight, and in embodiments from about 6 to about 8 percent by weight, of the toner particles (that is, toner particles exclusive of external additives and water).

As noted above, in embodiments a toner of the present disclosure may also include at least one high molecular weight branched or cross-linked amorphous polyester resin. This high molecular weight resin may include, in embodiments, for example, a branched amorphous resin or amorphous polyester, a cross-linked amorphous resin or amorphous polyester, or mixtures thereof, or a non-cross-linked amorphous polyester resin that has been subjected to cross-linking. In accordance with the present disclosure, from about 1% by weight to about 100% by weight of the high molecular weight amorphous polyester resin may be branched or cross-linked, in embodiments from about 2% by weight to about 50% by weight of the higher molecular weight amorphous polyester resin may be branched or cross-linked.

In embodiments, toner particles of the present disclosure may have a core including from about 0% by weight to about 50% by weight of a low molecular weight, high Tg, amorphous resin, in embodiments from about 10% by weight to about 40% by weight of a low molecular weight, high Tg, amorphous resin, in combination with from about 0% by weight to about 50% by weight of a high molecular weight, low Tg, amorphous resin, in embodiments from about 10% by weight to about 40% by weight of a high molecular weight, low Tg, amorphous resin. Such toner particles may also include a shell including from about 0% by weight to about 35% by weight of a low molecular weight, high Tg, amorphous resin, in embodiments from about 10% by weight to about 25% by weight of a low molecular weight, high Tg, amorphous resin, optionally in combination with from about 0% by weight to about 35% by weight of a high molecular weight, low Tg, amorphous resin, in embodiments from about 10% by weight to about 25% by weight of a high molecular weight, low Tg, amorphous resin.

The ratio of crystalline resin to the amorphous resin in a toner utilizing such resins can be from about 1:99 to about 40:60, in embodiments from about 3:97 to about 20:80, in embodiments from about 5:95 to about 15:95.

In embodiments, a latex emulsion may be formed by emulsion aggregation methods. Utilizing such methods, the resin may be present in a resin emulsion, which may then be combined with other components and additives to form a toner of the present disclosure.

Toner

The emulsions as described above may be utilized to form toner compositions by any method within the purview of those skilled in the art. The latex emulsion may be contacted with a colorant, optionally in a dispersion, and other additives to form a toner by a suitable process, in embodiments, an emulsion aggregation and coalescence process.

Surfactants

In embodiments, resins, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be added as a solid or as a highly concentrated solution with a concentration of from about 10% to about 100% (pure surfactant) by weight, in embodiments, from about 15% to about 75% by weight.

In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA210™, IGEPAL CA520™, IGEPAL CA720™, IGEPAL CO890™, IGEPAL CO720™, IGEPAL CO290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108. Combinations of these surfactants and any of the foregoing nonionic surfactants may be utilized in embodiments.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the optional colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP604™, NP608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and optional colorant in forming toner particles. The wax may be provided in a wax dispersion, which may include a single type of wax or a mixture of two or more different waxes. A single wax may be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, from about 1 weight percent to about 25 weight percent of the toner particles, in embodiments from about 5 weight percent to about 20 weight percent of the toner particles.

When a wax dispersion is used, the wax dispersion may include any of the various waxes conventionally used in emulsion aggregation toner compositions. Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of one or more aqueous emulsions or dispersions of solid wax in water, where the solid wax particle size may be in the range of from about 100 to about 300 nm.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, a process of the present disclosure may include contacting at least one resin with at least one surfactant to form an emulsion; contacting the emulsion with an optional wax and an optional colorant to form a primary slurry; aggregating the at least one resin with an aggregating agent to form aggregated particles; coalescing the aggregated particles to form toner particles; and recovering the toner particles.

In embodiments, the optional additional ingredients of a toner composition including colorant, wax, and other additives may be added before, during or after preparing the resin emulsion. The additional ingredients can be added before, during or after the addition of the optional surfactant. In further embodiments, the colorant may be added before the addition of the optional surfactant.

"Toner-sized" indicates that the droplets have a size comparable to toner particles used in xerographic electrophotographic printers and copiers, wherein "toner sized" in embodiments indicates a volume average diameter of, for example, from about 2 μm to about 25 μm, in embodiments from about 3 μm to about 15 μm, in other embodiments from about 4 μm to about 10 μm. As it may be difficult to directly measure droplet size in the emulsion, the droplet size in the emulsion may be determined by solidifying the toner-sized droplets and then measuring the resulting toner particles.

Because the droplets may be toner-sized in the disperse phase of the emulsion, in embodiments there may be no need to aggregate the droplets to increase the size thereof prior to solidifying the droplets to result in toner particles. However, such aggregation/coalescence of the droplets is optional and can be employed in embodiments of the present disclosure, including the aggregation/coalescence techniques described in, for example, U.S. Patent Application Publication No. 2007/0088117, the disclosure of which is hereby incorporated by reference in its entirety.

In embodiments, toner compositions may be prepared by emulsion-aggregation processes, such as a process that includes aggregating a mixture of an optional colorant, an optional wax and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid, or the like. In embodiments, the pH of the mixture may be adjusted to from about 2 to about 5. Additionally, in embodiments, the mixture may be homogenized. If the mixture is homogenized, homogenization may be accomplished by mixing at from about 3,000 to about 5,000 revolutions per minute (rpm). Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

Suitable examples of organic cationic aggregating agents include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, and the like, and mixtures thereof.

Other suitable aggregating agents also include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the aggregating agent is a polyion aggregating agent, the agent may have any desired number of polyion atoms present. For example, in embodiments, suitable polyaluminum compounds have from about 2 to about 13, in other embodiments, from about 3 to about 8, aluminum ions present in the compound.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture. This provides a sufficient amount of agent for aggregation.

The particles may be permitted to aggregate until a predetermined desired particle size is obtained and at a temperature that is below the glass transition temperature of the resin as discussed above, in embodiments from about 30° C. to about 90° C., in embodiments from about 35° C. to about 70° C. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 30° C. to about 99° C., and holding the mixture at this temperature for a time from about 0.5 hours to about 10 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Shell Resin

In embodiments, after aggregation, but prior to coalescence, a shell may be applied to the aggregated particles. Any resin described above as suitable for forming the core resin may be utilized as the shell. In embodiments, a polyester amorphous resin latex as described above may be included in the shell.

In embodiments, an amorphous resin which may be utilized to form a shell in accordance with the present disclosure includes an amorphous polyester, optionally in combination with an additional polyester resin latex. Multiple resins may thus be utilized in any suitable amounts. In embodiments, a first amorphous polyester resin, for example an amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

The shell resin may be applied to the aggregated particles by any method within the purview of those skilled in the art. In embodiments, the resins utilized to form the shell may be in an emulsion including any surfactant described above. The emulsion possessing the resins may be combined with the aggregated particles described above so that the shell forms over the aggregated particles.

The formation of the shell over the aggregated particles may occur while heating to a temperature of from about 30° C. to about 80° C., in embodiments from about 35° C. to about 70° C. The formation of the shell may take place for a period of time of from about 5 minutes to about 10 hours, in embodiments from about 10 minutes to about 5 hours.

Coalescence

Following aggregation to the desired particle size and application of an optional shell resin described above, the particles may then be coalesced to the desired final shape, the coalescence being achieved by, for example, heating the mixture to a suitable temperature. This temperature may, in embodiments, be from about 40° C. to about 99° C., in embodiments from about 50° C. to about 95° C. Higher or lower temperatures may be used, it being understood that the temperature is a function of the resins used.

Coalescence may be accomplished over a period of from about 10 minutes to about 600 minutes, in embodiments from about 30 minutes to about 360 minutes.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be washed, and then dried.

Washing

The triboelectric charge of toners is very important for obtaining good image quality. As noted above, EA toners may be prepared by a process of controlled aggregation of latex, pigment and wax dispersions, in which polymer, pigment and/or wax particles are stabilized by surfactants and dispersed in an aqueous media. As noted above, the process includes adding a metal halide coagulant followed by heating. Ions are thus introduced into the system during the EA process.

The surfactants and ions utilized in the processes described above are often required to facilitate pigment, wax and latex dispersion stability. It may also be necessary to have these surfactants and ions to control particle size and shape, as well as to provide stability of the toner particles prepared by the aggregation/coalescence process. Ionic species present on the toner particles thus include surfactants and other species that may be introduced from the water and chemicals used during the process of forming EA particles.

At the end of the EA process, before washing and drying, the overall surfactants and ions have four different locations among the toner liquid (slurry): 1) a majority of the surfactants and ions are dissolved in the continuous aqueous phase; 2) some amount of surfactants and ions are physically absorbed on the surface of the toner particles; 3) some amount of the surfactants and ions are inside the toner particles, but close to the particle surface (the outer layer); and 4) some amount of the surfactants and ions are buried deep inside the toner particles.

In general, it is desirable to remove the surfactants and ions from the final toner. If the surfactant remains in the toner, it may lower the charging of the toner and increase the sensitivity of the toner to environmental fluctuations in temperature and relative humidity (RH). In particular, the surfactants and ions on the surface of a toner particle may have a negative influence at high temperature and humidity. Thus, stable developing and transfer properties of a toner may not be attained.

In addition, surfactants and ions on the surface of the toner particles may lead to decreases in the flowability of the toner, its stability over time, and problems with maintaining charge of the toner. While surfactants and ions buried deep inside the toner may have limited impact on the final toner charging and machine performance, surfactants and ions in the aqueous phase, physically absorbed on the surface, and inside the particle, but close to the particle surface, should be removed.

Conventionally, ions may be removed from the surface of toner particles by washing the particles with reverse osmosis water (ROW) and sometimes the addition of an acid during the washing process. The limitation of the conventional washing process is that it may only be effective in removing surface species of ions from the toner particles.

In accordance with the present disclosure, a highly efficient washing process is provided which includes the use of a washing aid agent. As used herein, a "washing aid agent," in embodiments, acts as a resin dissolver which helps to swell the toner particle surface. The washing aid agent works by swelling the particle surface, opening the particle surface, and hence allowing the removal of ionic species from the surface, including ionic species absorbed onto the surface or located inside the toner particle but just beneath the particle surface. As noted above, ionic species just under the particle surface, although not at the surface, can still have an impact on the toner charge. The exposure of these ions, due to the washing aid agent, facilitates their removal during the washing process. This can ensure that the resulting toners possess good charging levels, charge stability, and decreased sensitivity to environmental fluctuations in temperature and RH.

Suitable washing aid agents for use in accordance with the present disclosure include, for example, hydroxyl-functional compounds having from 1 to about 4 hydroxy groups, in embodiments from about 2 to about 3 hydroxyl groups. Such hydroxyl-functional compounds include, for example, 2-phenoxy ethanol, propylene glycol, 1-(2-butoxyethoxy)-ethanol, glycol ethers like diethylene glycol monobutyl ether, ethylene glycol monopropyl ether, ethylene glycol monohexyl ether, diethylene glycol monomethyl ether, diethylene glycol monoethyl ether, and diethylene glycol monohexyl ether, alykoxytriglycols like triethylene glycol monomethyl ether, triethylene glycol monoethyl ether, triethylene glycol monobutyl ether, combinations thereof, and the like.

In embodiments, a suitable washing aid agent includes PICO PS1025, commercially available from PICO Chemical Corp. (Chicago Heights, Ill.), which includes 2-phenoxy ethanol, with smaller amounts of propylene glycol, 1-(2-butoxyethoxy)-ethanol, and diethylene glycol monobutyl ether.

The washing agent may be added to the toner particles in amounts of from about 0.001% by weight of the toner particles to about 10% by weight of the toner particles, in embodiments from about 0.01% by weight of the toner particles to about 5% by weight of the toner particles, in embodiments from about 0.1% by weight of the toner particles to about 2% by weight of the toner particles.

As noted above, the addition of the washing aid agent in accordance with the present disclosure may enhance the removal of ions in any subsequent washing step or steps. In embodiments, washing may include subjecting the toner particles, having already been treated with the washing aid agent, to from about 1 wash to about 8 washes with deionized water, in embodiments from about 2 washes to about 6 washes with deionized water, in embodiments from about 2 washes to about 4 washes with deionized water. The amount of water utilized to wash the toner particles may be from about 2 times the weight of the final dry toner to about 36 times the weight of the final dry toner of deionized water per wash, in embodiments from about 6 times the weight of the final dry toner to about 30 times the weight of the final dry toner, in embodiments from about 10 times of the final dry toner to about 24 times the weight of the final dry toner. The total amount of deionized water used for the washes may be from about 10 times the weight of the final dry toner to about 40 times the weight of the final dry toner, in embodiments from about 12 times the weight of the final dry toner to about 30 times the weight of the final dry toner, in embodiments from about 16 times the weight of the final dry toner to about 20 times the weight of the final dry toner.

After washing, the particles may be dried. Drying may be accomplished by any suitable method for drying including, for example, freeze-drying.

In accordance with the present disclosure, it has been found the presence of the washing aid agent may remove additional ionic species from the toner particles, which results in higher charge, especially in A-zone, and lower sensitivity to changes in the environment, including temperature and RH. Even though the ion removal mechanism involves swelling of the toner particle surface, no degradation in fusing performance such as gloss, minimum fix temperature, rub, and fusing latitude, was observed. In addition, blocking data showed no degradation in performance.

Toners washed in accordance with the present disclosure may have a triboelectric charge of from about −20 μC/g to about −65 μC/g, in embodiments from about −30 μC/g to about −50 μC/g.

Additives

In embodiments, the toner particles may also contain other optional additives, as desired or required. For example, the toner may include positive or negative charge control agents, for example in an amount of from about 0.1 to about 10% by weight of the toner, in embodiments from about 1 to about 3% by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Orient Chemical Industries, Ltd.); combinations thereof, and the like.

There can be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, calcium stearates, aluminum oxides, cerium oxides, or long chain acids such as UNILIN 700, and mixtures thereof.

In general, silica may be applied to the toner surface for toner flow, triboelectric charge enhancement, admix control, improved development and transfer stability, and higher toner blocking temperature. $TiO_2$ may be applied for improved relative humidity (RH) stability, triboelectric charge control and improved development and transfer stability. Zinc stearate, calcium stearate and/or magnesium stearate may optionally also be used as an external additive for providing lubricating properties, developer conductivity, triboelectric charge enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of these external additives may be present in an amount of from about 0.1 percent by weight to about 5 percent by weight of the toner, in embodiments of from about 0.25 percent by weight to about 3 percent by weight of the toner. In embodiments, the toners may include, for example, from about 0.1% by weight to about 5% by weight titania, from about 0.1% by weight to about 8% by weight silica, and from about 0.1% by weight to about 4% by weight zinc stearate.

Suitable additives include those disclosed in U.S. Pat. Nos. 3,590,000, 6,214,507, and 7,452,646 the disclosures of each of which are hereby incorporated by reference in their entirety. Again, these additives may be applied simultaneously with the shell resin described above or after application of the shell resin.

In embodiments, toners of the present disclosure may be utilized as ultra low melt (ULM) toners. In embodiments, the dry toner particles having a shell of the present disclosure may, exclusive of external surface additives, have the following characteristics:

(1) Volume average diameter (also referred to as "volume average particle diameter") of from about 3 to about 25 μm, in embodiments from about 4 to about 15 μm, in other embodiments from about 4.5 to about 10 μm.

(2) Number Average Geometric Size Distribution (GSDn) and/or Volume Average Geometric Size Distribution (GSDv) of from about 1.05 to about 1.55, in embodiments from about 1.1 to about 1.4.

(3) Circularity of from about 0.93 to about 1, in embodiments from about 0.95 to about 0.99.

(4) Coarse content of from about 0.01% to about 10%, in embodiments, of from about 0.05% to about 5%.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. The GSDv refers to the upper geometric standard deviation (GSDv) by volume (coarse level) for (D84/D50). The GSDn refers to the geometric standard deviation (GSDn) by number (fines level) for (D50/D16). The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles. The aforementioned GSD value for the toner particles indicates that the toner particles are made to have a narrow particle size distribution.

Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

The circularity of the toner particles may be determined by any suitable technique and apparatus. The circularity is a measure of the particles closeness to perfectly spherical. A circularity of 1.0 identifies a particle having the shape of a perfect circular sphere. Volume average circularity may be measured by means of a measuring instrument such as a Flow Particle Image Analysis (FPIA) such as for example the Sysmex® Flow Particle Image Analyzer, commercially available from Sysmex Corporation, operated in accordance with the manufacturer's instructions. Representative sampling may occur as follows: about 0.5 grams of toner sample may be obtained and filtered through a 25 micrometer screen, then put in deionized water to obtain a concentration of about 5%, with the sample then run in a Flow Particle Image Analyzer.

The coarse content of the toner particles may be determined by any suitable technique and apparatus. Coarse content may be measured by means of wet sieving using a sieve and collecting the coarse or a measuring instrument such as a coulter counter, such as the Beckman Coulter Counter Multisizer 3, commercially available from Beckman Coulter, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Examples 1 & 2

EA ultra low melt cyan toner particles were prepared as follows. The following components were combined in a 20 gallon reactor: about 14 parts of a high molecular weight polyester amorphous latex (including a high molecular weight polyester amorphous resin including alkoxylated bisphenol A with terephthalic acid, trimellitic acid, and dodecenylsuccinic acid co-monomers and resin having a Mw of about 63,400 Daltons), with a solids content of about 35% by weight (Latex A); about 14 parts of a low molecular weight polyester amorphous latex (including a low molecular weight polyester amorphous resin including alkoxylated bisphenol A with terephthalic acid, trimellitic acid, and dodecenylsuccinic acid co-monomers and resin having a Mw of about 20,000 Daltons), with a solids content of about 35% by weight (Latex B); about 4.7 parts of a crystalline polyester latex, including a crystalline resin of the following formula:

(II)

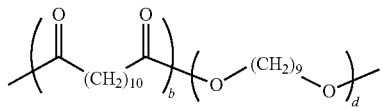

wherein b was from about 5 to about 2000 and d was from about 5 to about 2000, the crystalline polyester latex having a solids content of about 30% by weight (Latex C); about 5.8 parts of a polyethylene wax in a dispersion (having a solids content of about 30% by weight); about 6.7 parts of a cyan pigment, Pigment Blue 15:3 in a dispersion (at a solids content of about 17% by weight); and about 47 parts deionized (DI) water. Both the wax and pigment dispersions included TAYCA POWER BN2060, a branched sodium dodecyl benzene sulfonate (from Tayca Corporation (Japan)).

The resulting mixture was adjusted to a pH of about 3.2 using 0.3M $HNO_3$ acid. About 1 parts of a 10% by weight aluminum sulfate solution in water was added to the mixture over a period of about 5 minutes, with homogenization at about 2,000 revolutions per minute (rpm). The reactor was then stirred at about 50 rpm and heated to about 48° C. to aggregate the toner particles.

When the size of the toner particles reached about 5 μm, a shell coating was added which included about 7.6 parts Latex A, about 7.6 parts Latex B, about 0.1 parts of an alkyldiphenyloxide disulfonate surfactant, commercially available as DOWFAX™ 2A1 from The Dow Chemical Company, and about 100 parts DI water. The reaction was heated to about 50° C. When the toner particle size reached about 5.8 μm, the pH was adjusted to about 5 using a 4% NaOH solution. The mixing speed in the reactor was then decreased to about 45 rpm, followed by the addition of about 0.7 parts of ethylene diamine tetraacetic acid (EDTA) (commercially available as VERSENE-100 from the Dow Chemical Company. The pH was then adjusted and maintained at about 7.5 and the toner solution was heated to the coalescence temperature of about 85° C.

When the coalescence temperature was reached, the pH was lowered to a value of about 7.3 to allow spheroidization (coalescence) of the toner. After a period of time of from about 1.5 hours to about 3 hours, when the desired circularity of about 0.964 was obtained, the toner was "quenched" to less than about 45° C. through a heat exchanger.

Washing

After cooling, the toners were washed to remove any residual surfactants and ions. The washing process, which removed surfactants and ions, included 4 major steps. The first step included removal of mother liquor from the combined dispersions described above. Varying amounts of a washing aid agent, as set forth below in Table 1, were added into the slurry. The washing agent was PICO PS1025, commercially available from PICO Chemical Corp., which is primarily 2-phenoxy ethanol, with smaller amounts of propylene glycol, 1-(2-butoxyethoxy)-ethanol, and diethylene glycol monobutyl ether. After cooling and wet sieving, the mixture was mixed at a speed of about 120 rpm for about 40 minutes to allow the surface of the toner particles to swell. The material was pumped into a LAROX PF0.4 pressure filter (from Larox Flowsys, Finland) at a controlled rate of about 20 kg/minute and feed pumping pressure of about 2 bar. After pressing the contents under about 2 bars of pressure, the liquid (filtrate) was removed and a wet cake was formed inside the LAROX PF0.4 pressure filter.

In the second step, the wetcake was discharged into a tank and re-dispersed with reverse osmosis water (ROW) (about 10 times the amount of the final dry toner), with mixing for about 40 minutes and adding additional washing aid agent as set forth in Table 1 below.

In the third step, the slurry was pumped into the LAROX PF0.4 pressure filter at a controlled rate of about 20 kg/minute and feed pumping pressure of about 2 bar, and de-watered by pressing at a pressure of about 4 bar before ROW was pumped into the LAROX PF0.4 pressure filter (about 8 times) for dynamic washing.

In the fourth step, the cake was subjected to about 8 bars of pressure, followed by air drying for about 600 seconds.

Control toner particles were treated following the same process, except the washing aid agent was not added to the control particles.

After washing, the toners were dried to a moisture content below about 1.2% by weight.

Table 1 below summarizes the conditions for forming toners with the processes of the present disclosure, including the use of different amounts of washing aid agents, and the control toners, which did not include the washing aid agent.

TABLE 1

| Toner Sample ID | Doped PS1025 in Step #1 (wt %) | Water amount in Step #2 (X) | Doped PS1025 in Step #2 (wt %) | Water amount in Step #3 (X) | Total water (X based on dry toner) |
|---|---|---|---|---|---|
| Cyan toner Example #1 | 0.2 | 7 | 0.1 | 8 | 15 |
| Cyan toner Example #2 | 0.1 | 10 | 0 | 8 | 18 |
| Comparison Sample | 0 | 10 | 0 | 8 | 15 |

X = the amount of water (by weight), used as a multiple of the weight of the final dry toner.

Machine Testing

The toners were analyzed for minimum fusing temperature (MFT), Gloss, glass transition temperature (Tg), and Heat Cohesion onset temperature, and machine tested.

The above prepared cyan toners and commercially available cyan toners (XEROX DCP 700 Cyan toners) from Xerox Corporation were evaluated in a XEROX 700 Digital Color Press machine, in the A-zone. The same additive package was used for both tests, and included:

- about 1.29% (based upon the weight of the particle) of a silica surface treated with polydimethylsiloxane, commercially available as RY50L from Evonik (Nippon Aerosil);
- about 0.86% of a hexamethylsilazane treated silica, commercially available as RX50 from Evonik (Nippon Aerosil);
- about 1.73% of a sol-gel silica surface treated with hexamethyldisilazane, commercially available as X24-9163A from Nisshin Chemical Kogyo
- about 0.88% of a titania treated with butyltrimethoxysiliane, commercially available as STT100H from Titan Kogyo;
- about 0.275% of a cerium dioxide, commercially available as E10 from Mitsui Mining & Smelting;
- about 0.18% of a zinc stearate, such as ZnFP available from NOF; and
- about 0.5% of polymethyl methacrylate (PMMA) polymer particles, such as MP116CF available from Soken.

Each toner was loaded into a commercially available refill pouch (containing additional titania), aged through 10,000 pages (10 kp) with toner concentration (TC) controlled to 8% by controlled addition of replenisher (estimate 95% switchover to test material by 4,000 pages (4 kp)). After that, the toner concentration latitude was evaluated, which was controlled by weight.

Results

Table 2 below summarizes some of the properties of the resulting toner particles after treatment by the different washing methods.

X-Ray Photoelectron Spectroscopy (XPS) was utilized to determine the amount of wax, ions on the surface of toners by measuring the attenuation of the oxygen signal due to the resin.

TABLE 2

| | | | Surface | Machine Azone test results | | |
|---|---|---|---|---|---|---|
| Toner Sample ID | DOWFAX (ppm) | TAYCA (ppm) | Na by XPS (%) | Tribo | A (t) | Density 60% |
| Cyan toner Example #1 | 467 | 2783 | 0.21 | 25.2 | 285 | 1.0 |
| Cyan toner Example #2 | 503 | 4480 | 0.30 | 22.0 | 249 | 1.22 |
| Comparison Sample | 667 | 5213 | 0.51 | 19.5 | 220 | 1.31 |

Tribo = triboelectric charge
A (t) = (toner concentration + 4) * Tribo
Density 60% = Image density at 60% coverage as measured by a reflection densitometer The toners were analyzed with X-ray Photoelectron Spectroscopy (XPS), a surface analysis technique that provided elemental, chemical state, and quantitative analyses for the top 2-5 nanometers of each sample's surface. For XPS, the top surface elemental composition can be readily determined from energy positions of the peaks in a broad scan survey spectrum. Detailed chemical bonding information (e.g., oxidation states) can be obtained from narrower, high resolution window region spectra. XPS is particularly useful when analyzing plastics, rubber compounds, and other samples easily damaged by alternate radiations. In addition, insulating materials that charge severely upon excitation by other sources can be readily examined with XPS.

The parent toners were placed in DSC hermetic sample cups and then heated to 50° C., 65° C. and 90° C. and held at temperature for 2 minutes. The toners in the DSC sample cups were submitted for analysis by XPS. The toners were analyzed intact in the cups with no modification to the samples. Room temperature samples were presented to the x-ray source by depositing the material onto double-backed conductive copper adhesive tape adhered to a stainless steel sample holder. A region about 1 millimeter in diameter was analyzed. The quantitative analyses were precise to within 5% relative for major constituents and 10% relative for minor constituents.

The residual surfactants of the parent particle were characterized via liquid chromatography/mass spectroscopy (LC/MS). A quadratic standard calibration curve was constructed by dissolving appropriate amount of TAYCA POWER BN2060 (~750 μg/mL) and DOWFAX™ 2A1 (~250 μg/mL) into methanol and performing a single 100× dilution in water from this standard stock solution, followed by 2 serial dilutions until the standards bracketed the analyte response. The peak areas of standards were plotted against their concentrations, generating a quadratic calibration curve.

About 0.4 grams of latex was weighed into a 50 mL polypropylene centrifuge tube and added 30 mL of methanol was added thereto. The samples were shaken for 1 hour and centrifuged at 3000 rpm for 5 minutes. A 20× dilution in water was performed before the sample was injected on LC/MS. Filtrates were injected as received or diluted in water.

LC/MS Conditions:

Standards and samples were analyzed using an Accela High Speed LC system interfaced to TSQ Quantum Access mass spectrometer. The mass spectrometer was operated in negative electrospray ionization SIM mode with spray voltage of 3500 V, capillary temperature 300° C., and m/z 325 for TAYCA POWER BN2060 and 497 for DOWFAX™ 2A1 were monitored. About 5 μL of sample was injected using full loop injection mode with 5 μL sample loop fitted to the LC and separated on a Hypersil Gold C18, 50×2.1 mm, 1.9 μm column. The isocratic elution included 20% 20 mM ammonium acetate, 0.1% acetic acid in water, and 80% 20 mM ammonium acetate in 4/48/48 water/acetonitrile/methanol at 0.50 mL/min. The column temperature was 50° C.

Toner cohesion and blocking were evaluated. Toner blocking was determined by measuring the toner cohesion at elevated temperature above room temperature. Toner blocking measurement was completed as follows: two grams of additive toner was weighed into an open dish and conditioned in an environmental chamber at the specified elevated temperature and 50% relative humidity. After about 17 hours the samples were removed and acclimated in ambient conditions for about 30 minutes. Each re-acclimated sample was measured by sieving through a stack of two pre-weighed mesh sieves, which were stacked as follows: 1000 μm on top and 106 μm on bottom. The sieves were vibrated for about 90 seconds at about 1 mm amplitude with a Hosokawa flow tester. After the vibration was completed, the sieves were reweighed and toner blocking was calculated from the total amount of toner remaining on both sieves as a percentage of the starting weight. Thus, for a 2 gram toner sample, if A was the weight of toner left on the top 1000 μm screen and B was the weight of toner left the bottom 106 μm screen, the toner blocking percentage was calculated by:

$$\% \text{ blocking}=50(A+B)$$

Table 3 below summarizes the toner cohesion and blocking testing results.

TABLE 3

| Toner Sample ID | Surface Na by XPS (%) | Toner bench evaluation: Blocking onset temp (° C.) | Toner bench evaluation: Cohesion (%) |
|---|---|---|---|
| Cyan toner Example #1 | 0.21 | 53.5 | 32 |
| Cyan toner Example #2 | 0.30 | 54.0 | 39 |
| Comparison Sample (Control) | 0.51 | 53.5 | 45 |

From Table 3, one can conclude that the toner samples washed with the washing agents of the present disclosure had similar toner cohesion as the control sample. Moreover, the blocking onset temperature was equal to the control sample.

Toner fusing properties were determined as follows:

All unfused images were generated using a modified MITA copier. About 1.05 mg/cm$^2$ TMA (Toner Mass per unit Area) images were prepared on DCX+paper (Digital Color Xpressions+, 90 gsm, uncoated, commercially available from XEROX Corporation) for gloss, crease and hot offset measurements. The above TMA corresponded to process black or three layers of toner particles (for 5.5 micron particles). Gloss/crease targets were a square image placed in the center of the page. All the samples were then fused. Warm up time (room temperature to run temperature) for the fuser was about 35 seconds. The free belt nip fuser (FBNF), an oil-less fuser design with a fuser roll that included a 30 micron PFA (perfluoroalkyl) tube on top of 0.6 mm silicone rubber and a pressure belt. Process speed of the fuser was set to 194 mm/second (nip dwell of about 30 milliseconds) and the fuser roll temperature was varied from cold offset to hot offset or up to 210° C. for gloss and crease measurements on DCX+paper.

After the set point temperature of the fuser roll was changed, ten minutes elapsed to allow the temperature of the belt and pressure assembly to stabilize. Crease area measurements were carried out with an image analysis system and BYK Gardner 75° gloss meter was used to measure print gloss as a function of fuser roll temperature on DCX+paper.

Toner to toner, and toner to paper, sections for document offset testing were cut from the sheet, 5 cm by 5 cm, and placed in an environmental chamber under a 80 g/cm$^2$ load at 60° C. and 50% relative humidity (RH) for 24 hours.

In addition to ranking the samples with predefined SIR (Standard Image Reference) offset charts, IQAF (Image Quality Analysis) software and an EPSON GT30000 scanner were used to quantify the percentage of toner transferred to toner and to paper. The IQAF spots metric was used to determine the amount toner transferred to paper.

To quantify the observed damage found with the toner-toner samples the rmsLA (root mean square L*average) metric was used. In all cases the lower the percent area of spots, or rmsLA values, the less damage that occurred. Table 4 below summarizes the toner fusing testing results.

TABLE 4

| | Cyan toner Example #1 | Cyan toner Example #2 | Comparison Sample (Control) |
|---|---|---|---|
| Cold offset on CX+ | 122 | 123 | 123 |
| Gloss at MFT on CX+ | 25.2 | 23.5 | 25.6 |
| Gloss at 185° C. on CX+ | 70.6 | 67.9 | 65.9 |
| Peak Gloss on CX+ | 71.7 | 68.6 | 66.9 |
| T(Gloss 50) on CX+ | 145 | 148 | 148 |
| T(Gloss 60) on CX+ | 157 | 159 | 161 |

TABLE 4-continued

| | Cyan toner Example #1 | Cyan toner Example #2 | Comparison Sample (Control) |
|---|---|---|---|
| $MFT_{CA-80}$ (extrapolated MFT) | 129 | 124 | 126 |
| ΔMFT (EA/SA-40° C.) (relative to a conventional EA toner using the same resins fused the same day) | −29 | −30 | −28 |
| Hot Offset CX+ 194 mm/s | 210 | 200 | 200 |
| Fusing Latitude HO-MFT on CX+ (>50) | 81 | 76 | 74 |
| ΔFix ($T_{G50}$ & $MFT_{CA-80}$) | −25 | −24 | −24 |
| 24 hour @ 60° C. Document Offset Toner-Toner/Toner-Paper (rmsLA/% voids) | 4.25/3.25 0.002/0.10% | 4.50/3.00 0.002/0.30% | 4.50/N/A 0.002/% |

CX+ = paper utilized from Xerox Corporation
MFT = minimum fusing temperature
Fusing Latitude = Hot Offset − MFT on CX+ paper
Δfix is the minimum fusing temperature required to reach 50 gloss units or a crease fix area of 80 relative to some control toner.
24-hour @ 60° C. Document Offset Toner = amount of Toner to toner and toner to paper document offset test conducted at 60° C./80 g/cm$^2$/50% R.H.
rmsLA/VOIDS root mean square L * average
ΔMFT(EA/SA-40° C.) = minimum fixing temperature in reference to a styrene-acrylate emulsion aggregation type toner
Hot Offset = the temperature at which the toner will lift off the paper and stick to the fuser roll
T(Gloss 50) = temperature at which the toner reaches 50 gloss units
T(Gloss 60) = temperature at which the toner reaches 60 gloss units As can be seen from Table 4, the toner samples washed with the washing agents of the present disclosure had similar fusing performance as the control sample.

The amount of surface wax was also determined by XPS. Table 5 summarizes the triboelectric charge results and amount of surface wax.

TABLE 5

| Toner Sample ID | Surface Wax (%) | Surface Na by XPS (%) | Toner Bench Tribo A Zone Tribo | A Zone A (t) | B Zone Tribo | B Zone A (t) | J Zone Tribo | J Zone A (t) | J/A |
|---|---|---|---|---|---|---|---|---|---|
| Cyan toner Example #1 | 8 | 0.21 | 34.4 | 388 | 52 | 584 | 66.2 | 734 | 1.89 |
| Cyan toner Example #2 | 9 | 0.30 | 31.5 | 355 | 51.4 | 584 | 65.2 | 723 | 2.04 |
| Comparison Sample | 8 | 0.51 | 27.4 | 307 | 47.1 | 525 | 60.9 | 685 | 2.23 |

As can be seen in Table 5, toner samples prepared with the washing agents of the present disclosure had higher triboelectric charge than the control sample in all three zones, and better RH sensitivity. The amount of surface wax was almost the same for all the three samples, indicating that the washing agent didn't impact the amount of surface wax on the particle surface.

As seen from the above Tables, with the addition of the washing aid agent, the residual surfactants and ions on the toner were reduced, even with lower amounts of total washing water, which resulted in higher toner triboelectric charge and better (lower) image density.

The other test results showed no difference between the toner samples in terms of toner Tg, rheology, and MFT which suggests that no residual amounts of the washing aid agent remained to adversely impact toner performance.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An emulsion aggregation method for producing toner comprising: contacting at least one resin with at least one surfactant, an optional wax, and an optional colorant to form a primary slurry; aggregating the at least one resin with an aggregating agent to form aggregated particles; coalescing the aggregated particles to form toner particles; contacting the toner particles with at least one washing aid agent, to swell the toner particle surface, wherein the washing aid agent comprises 2-phenoxy ethanol, propylene glycol, 1-(2-butoxyethoxy)-ethanol, and diethylene glycol monobutyl ether; washing the toner panicles to remove surfactants and ions from the toner particle surface and inside an outer layer; and recovering the toner particles.

2. The method of claim 1, wherein the at least one resin comprises at least one amorphous resin optionally in combination with at least one crystalline resin.

3. The method of claim 1, wherein the at least one surfactant is selected from the group consisting of anionic surfactants, nonionic surfactants, cationic surfactants, and combinations thereof, present in an amount from about 0.01% to about 20% by weight of the resin.

4. The method of claim 1, wherein the aggregating agent is selected from the group consisting of polyaluminum chloride, polyaluminum bromide, polyaluminum fluoride, polyaluminum iodide, polyaluminum sulfosilicate, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof, present in an amount of from about 0.1% to about 8% by weight of the resin.

5. The method of claim 1, wherein the washing aid agent is added to the primary slurry in an amount of from about 0.001% to about 10% by weight of the toner particles.

6. The method of claim 1, wherein washing the toner particles comprises subjecting, the toner particles to from about 1 to about 8 washes with deionized water.

7. The method of claim 1, wherein washing the toner particles comprises contacting the particles with deionized water in an amount from about 2 times the weight of dry toner to about 36 times the weight of dry toner per wash.

8. The method of claim 1, wherein the toner particles have a charge of from about −20 μC/g to about −65 μC/g.

9. An emulsion aggregation method for producing toner comprising:

contacting at least one amorphous polyester resin with at least one crystalline polyester resin, at least one surfactant, an optional wax, and an optional colorant to form a primary slurry;

aggregating, the at least one amorphous polyester resin in combination with at least one crystalline polyester resin with an aggregating agent to form aggregated particles;

coalescing the aggregated particles to form toner particles;

contacting the toner particles with at least one washing aid agent, to swell the toner particle surface, wherein the washing aid agent comprises 2-phenoxy ethanol, propylene glycol, 1-(2-butoxyethoxy)-ethanol and diethylene glycol monobutyl ether;

washing the toner particles to remove surfactants and ions from the toner particle surface and inside an outer layer; and recovering the toner particles.

10. The method of claim 9, wherein the at least one surfactant is selected from the group consisting of anionic surfactants, nonionic surfactants, cationic surfactants, and combinations thereof, present in an amount from about 0.01% to about 20% by weight of the resin.

11. The method of claim 9, wherein the aggregating agent is selected from the group consisting of polyaluminum chloride, polyaluminum bromide, polyaluminum fluoride, polyaluminum iodide, polyaluminum sulfosilicate, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfite, zinc acetate, zinc nitrate, zinc sulfate, zinc chloride, zinc bromide, magnesium bromide, copper chloride, copper sulfate, and combinations thereof, present in an amount of from about 0.1% to about 8% by weight of the resin.

12. The method of claim 9, wherein the washing aid agent is added to the primary slurry in an amount of from about 0.001% to about 10% by weight of the toner particles.

13. The method of claim 9, wherein washing the toner particles comprises subjecting the toner particles to from about 1 to about 8 washes with deionized water in an amount from about 2 times the weight of dry toner to about 36 times the weight of dry toner per wash.

14. The method of claim 9, wherein the toner particles have a charge of from about −20 μC/g to about −65 μC/g.

* * * * *